US006866574B2

(12) United States Patent
Abe et al.

(10) Patent No.: US 6,866,574 B2
(45) Date of Patent: Mar. 15, 2005

(54) APPARATUS FOR SELECTIVELY DISPENSING DISCS

(75) Inventors: Hiroshi Abe, Iwatsuki (JP); Minoru Enomoto, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 150 days.

(21) Appl. No.: 10/345,793

(22) Filed: Jan. 16, 2003

(65) Prior Publication Data

US 2003/0148728 A1 Aug. 7, 2003

(30) Foreign Application Priority Data

Jan. 17, 2002 (JP) ..... 2002-009278
Dec. 16, 2002 (JP) ..... 2002-364303

(51) Int. Cl.[7] ..... G70D 1/00
(52) U.S. Cl. ..... 453/52
(58) Field of Search ..... 453/18, 52, 29, 453/50, 51, 43, 44, 49

(56) References Cited

U.S. PATENT DOCUMENTS 5,810,655 A * 9/1998 Suzukawa et al. ..... 453/50
5,931,732 A * 8/1999 Abe et al. ..... 453/50
6,059,651 A * 5/2000 Abe et al. ..... 453/50

FOREIGN PATENT DOCUMENTS

JP 8-293051 11/1996 ..... G07D/1/00
JP 10-49725 2/1998 ..... G07D/9/00

* cited by examiner

*Primary Examiner*—Donald P. Walsh
*Assistant Examiner*—Mark J. Beauchaine

(57) ABSTRACT

A diverting device for directing discs exiting from a guiding passageway of a disc dispensing mechanism includes a contactor member that is axially movable along an exit opening of the guiding passageway and a diverter member that can be selectively inserted into the exit opening off of the center line of the guiding passageway for varying the direction of the exiting discs. The diverter member can be selectively inserted into the passageway in a direction perpendicular to a plane containing the center line by an activator.

13 Claims, 14 Drawing Sheets

APPARATUS FOR SELECTIVELY DISPENSING DISCS

BACKGROUND OF THE INVENTION

1. Field of the Invention

The present invention relates to an apparatus and method for dispensing discs such as coins or medals from a storage hopper of a coin dispensing mechanism and more particularly to a device to control the direction of a dispensed disc.

2. Description of Related Art

An apparatus for dispensing discs from a disc passageway having an outlet wherein discs are arranged in an edge-to-edge manner for storage and dispensing is disclosed in U.S. Pat. No. 5,931,732. A closure member such as rotatable spherical member, can close the outlet and is capable of selectively applying force to the face of a disc in the region of the outlet to dispense the disc through a guide assembly. The disc can be selectively diverted to one or the other side of the passageway. Problems can occur in that a disc can become wedged between an opening lower edge and a detecting member as the disc is pushed downwards by the detecting member. Thus, a disc that has jammed can be pushed through a diverting passageway with the subsequent disc, and the passageway can be obstructed by the pair of discs.

Other examples of the prior art can be found in the laid open Japanese Patent Application 8-293051 where the position of a guiding roller can be changed manually to be operative on either the left or right of a center line of the passageway.

There is still a desire in the prior art to provide an automatic dispensing of a disc which can be selectively dispensed to either side of a coin passageway. Preferably such a device should be relatively compact and inexpensive.

SUMMARY OF THE INVENTION

A disc diverting device includes a disc guiding passageway which guides and aligns the disc along a center line of the passageway. A contactor member is located at an exit of the passageway and is offset from the center line to contact and direct a disc in a first-preferred direction. A diverter unit is also located to be operatively and selectively inserted into the passageway across from the contactor member. When the diverter is inserted into the passageway, the diverter unit causes a disc to contact the contactor member and to displace it and to be dispensed in a second preferred direction.

Thus, discs are guided to an exit aperture along a disc guiding passageway so that the contact with contactor member that is offset to one side of the center line of the passageway will cause the disc to be diverted in a first direction when an actuator unit is not activated to place a diverter member in the passageway. When the actuator is activated to place the diverter unit in the passageway, the diverter unit blocks the first passageway and forces the disc to displace the contactor member and to be disbursed in a second direction. This arrangement helps eliminate the jamming of discs and avoids the dispensing of double coins while maintaining a compact configuration.

The guiding passageway can include a base plate and a pair of guiding plates which are affixed to the base plate and are positioned a predetermined distance away from and parallel with the base plate. A supporting plate is located at the side of the guiding plates opposite the base plate. The disc exit aperture is provided at the upper section of the guiding plate. If discs are in the form of coins of a different denomination and size, the thickness of the guiding plate and the relative displacement between the guiding plates can be changed to accommodate an adjustment to a new disc diameter or monetary coin size. The contactor member can include a roller which is rotatable on a supporting shaft. The supporting shaft has a biasing device which can push or pull the ends of the supporting shaft in a preferred direction. The contactor member can provide a rolling contact to the disc to facilitate a smooth dispensing at a relatively low friction. If the biasing or urging force is equally applied to both ends of the supporting shaft, the supporting shaft can be moved approximately parallel to facilitate the dispensing of the disc.

The position of the contactor member can differ from one guiding plate to another to accommodate different sized discs. The contactor member which can be in the form of a roller is relatively supported on a supporting shaft which can be slidable in an elongated hole located at a base plate along an extension of the guiding passageway. Springs can be hooked to either side of the supporting shaft to spring bias the contactor member to a predetermined position.

The diverting member can be attached to a rotating lever that can move in a perpendicular direction to an axis or extending line of the guiding passageway. The lever unit can include a first lever which is located parallel to the guiding passageway and a second lever which extends perpendicularly to the guiding passageway. The second lever is connected to the upper section of the first lever and has an inverted L-shape so that it pivots on a shaft located apart from the first lever. An actuator can be linked to the second lever. The first lever can pivot about a shaft towards the guiding passageway and is stopped by a stopper and held in that position.

A method of diverting coins from a coin dispensing mechanism includes forcing a series of sequential coins along a coin guiding passageway to contact a contactor member to dispense the coin in a first direction. A diverter member can be selectively inserted at a position off a center line of the guiding passageway to contact and direct the coin in a second direction. The coin moves the contactor member as it exits in the second direction.

BRIEF DESCRIPTION OF THE DRAWINGS

The object and features of the present invention, which are believed to be novel, are set with particularity in the independent claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable a person skilled in the art to make and use the invention and sets forth the best modes contemplated by the inventors of carrying out their invention. Various modifications, however, will remain readily apparent to those skilled in the art, since the general principles of the present invention have been defined herein specifically to provide a disc deflecting device of a compact configuration that can be altered to accommodate different dimensioned disc or different sized monetary coins.

Figure 1:
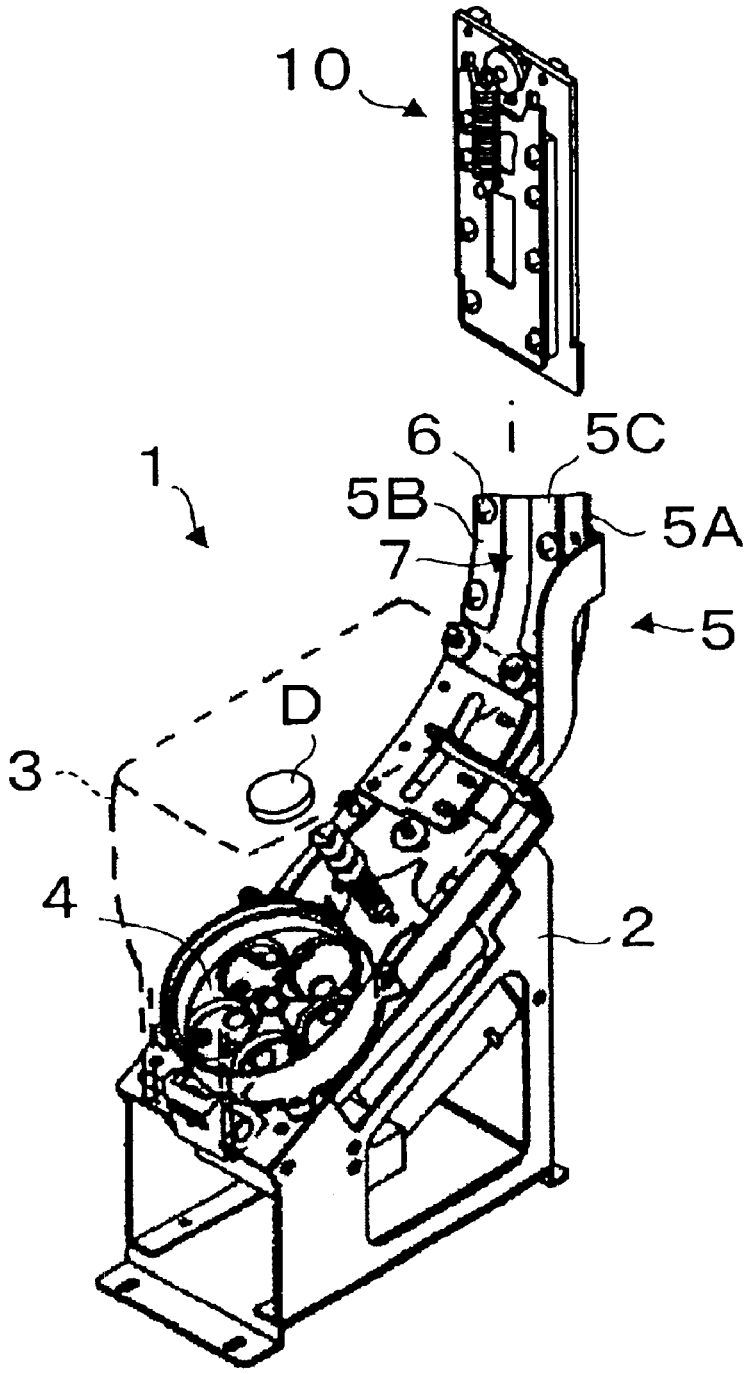
FIG. 1 is a perspective view of a hopper, coin selecter and guiding passageway of the first embodiment.

In FIG. 1, a hopper 1 includes a supporting frame 2, a bowl 3 (phantom lines) which is cylindrical like in shape and can store discs D, and a selecting rotating disk 4 for releasing a disc D from the hopper.

As an example, a hopper 1 is known in Japanese publication of unexamined patent application number 6-150102 and U.S. Pat. No. 5,931,732. The terms "discs" and "coins" can be used interchangeably and can, for example, be a monetary coin, token, medal, etc. Escalator 5 extends upwards and is fixed at frame 2 to provide a travel path for the discs. The escalator 5 includes a base 5A which is rectangular, a pair of spacers (not shown) which are slightly thicker than the thickness of the disc D and which are shaped like elongated plates and a pair of supporting plates 5B and 5C which also have contact with the spacers.

The distance of a pair of spacers is slightly larger than the diameter of disc D. The distance between supporting plates 5B and 5C is smaller than the distance between spacers. The supporting plates 5B, 5C and the spacers are fixed at base 5A by screws 6. Escalator guiding passageway 7 is enclosed by base 5A, the spacers and supporting plates 5B, 5C. A cross-section view of the passageway 7 is rectangular and extends vertically upward to move discs from the hopper to a desired dispensing exit position in the host machine, such as a vending machine.

Figure 2:
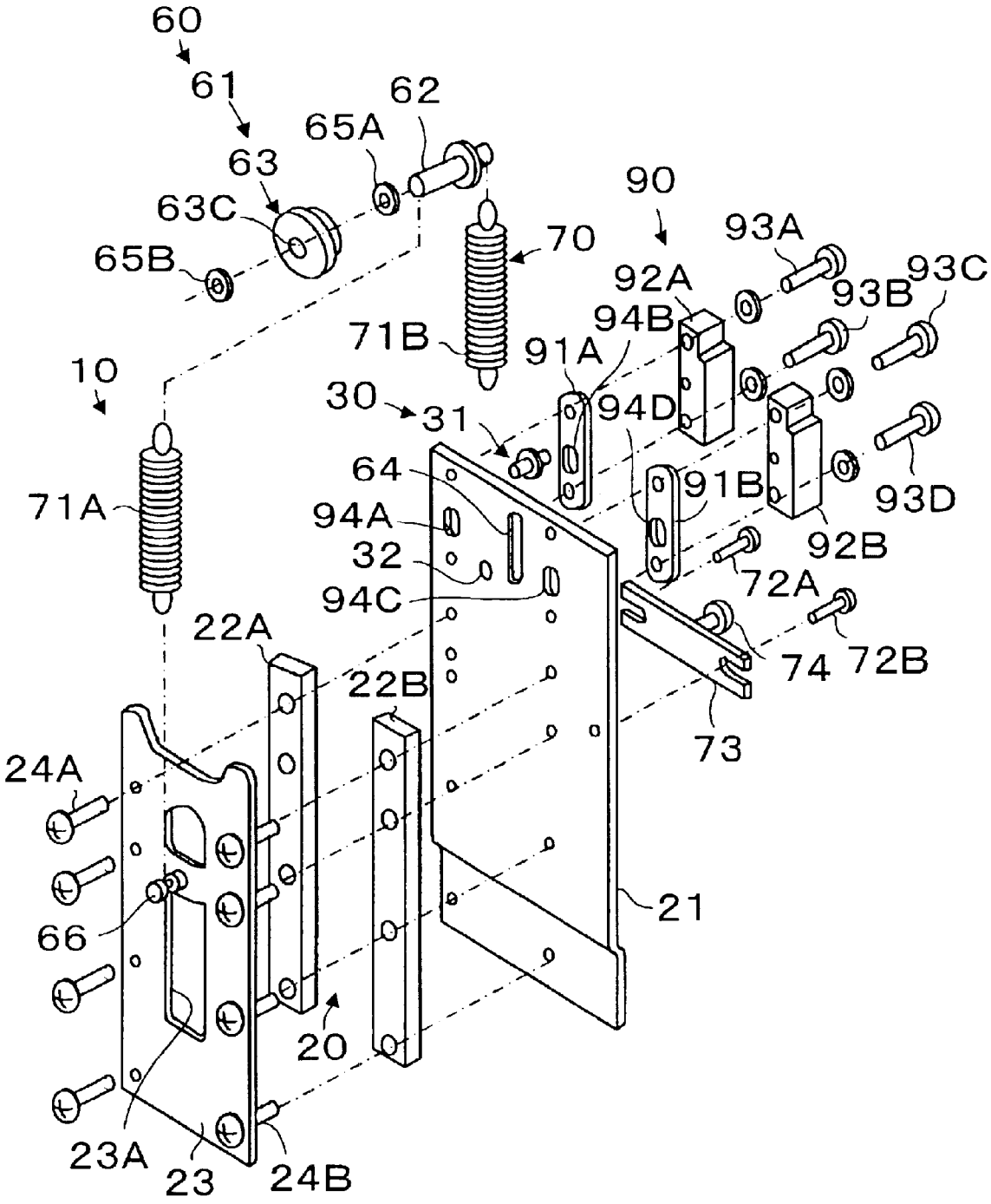
FIG. 2 is an exploded perspective view of coin exit diverting device.

A diverting device 10 is attached at the upper section of escalator 5 to contact and provide a directional discharge for the discs. The diverting device 10 includes a guiding passageway 20, deflector unit 30, an urging device 60, first exit 80, second exit 81 and a disc detecting device 90 as shown in FIG. 2.

Figure 4:
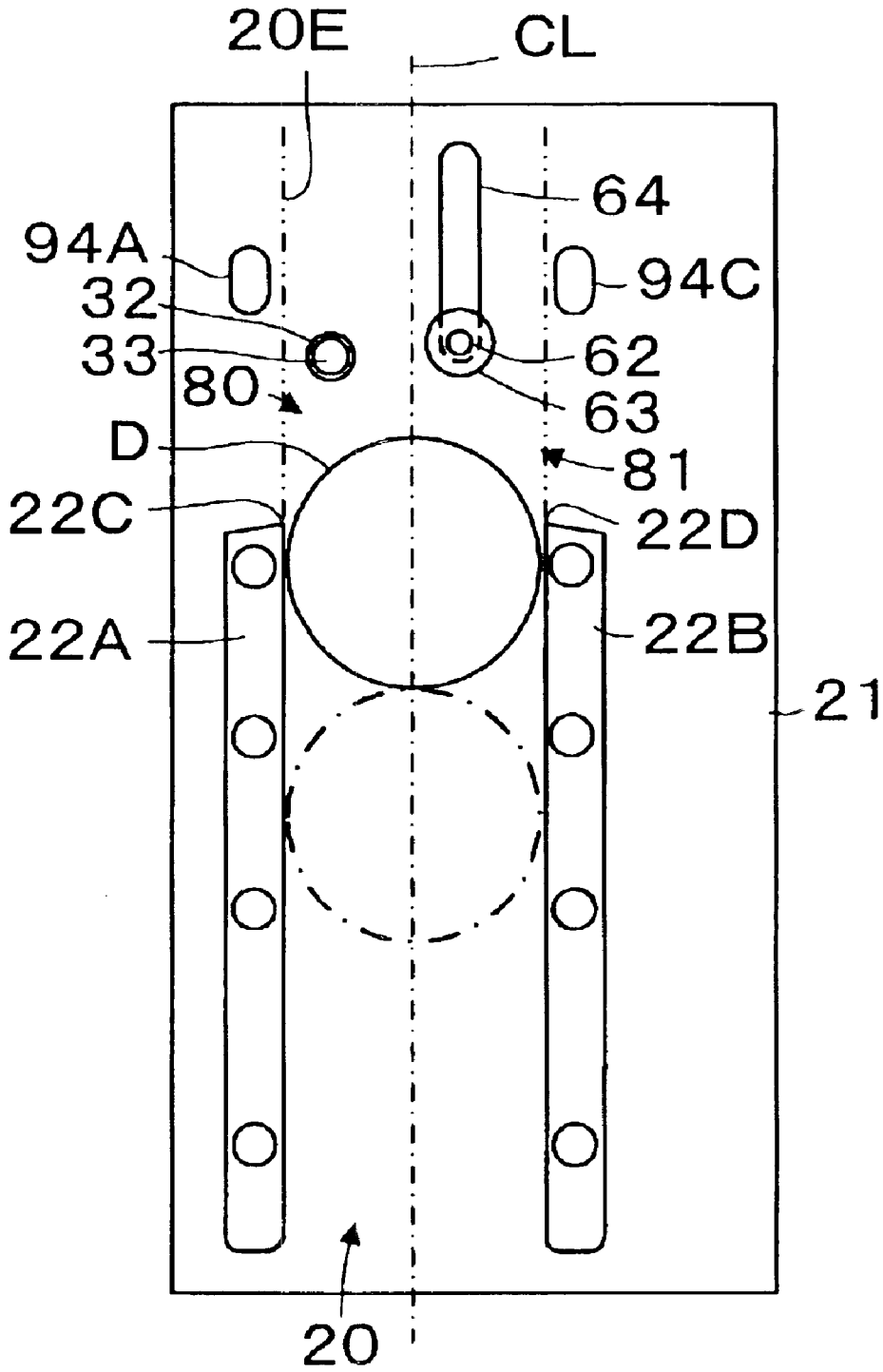
FIG. 4 is a partial elevated view of components of the first embodiment.

First, guiding passageway 20 is now explained. As shown in FIG. 2, base plate 21 is rectangular and the lower section has a moderate crank like shape and extends perpendicular to the plane of the rectangular area. A pair of spacers 22A, 22B are located at the front side (the left side in FIG. 2) of the base plate 21, and they are also parallel (as shown in FIG. 4). The spacers 22A and 22B act as the guiding plates for transporting discs.

The spacers 22A, 22B are also rectangular like in shape, and their upper sections slant downward to the outside and their distance is slightly larger than the diameter of a predetermined disc D. When a different diameter of disc D is used, the base plate 21 is changed and the distance between the spacers 22A, 22B is also changed to adapt to the new diameter.

Screws 24A penetrate into rectangle holding plate 23 and spacer 22A, and screw into the base plate 21. Screws 24B penetrate into rectangle holding plate 23 and spacer 22B, and screw into the base plate 21; therefore they are all connected together.

The guiding passageway 20 is enclosed by base plate 21, spacers 22A, 22B and holding plate 23. The guiding passageway 20 is rectangular in a cross-section view and extends perpendicular to the axis of movement of the discs. The width and thickness of the guiding passageway 20 are slightly larger than the diameter of disc D. A viewing hole 23A, on the guiding passageway 20, extends perpendicular and is located at the middle of the holding plate 23 to enable a technician to see the discs. When the diverting device 10 is operatively fixed at the top of the escalator 5, the spacers 22A, 22B are located on an extending line of the spacers (not shown). Therefore the guiding passageway 20 is located at the extending line of the escalator guiding passageway 7. As a result the discs D are pushed upwards from the escalator guiding passageway 7 to the guiding passageway 20.

Figure 3:
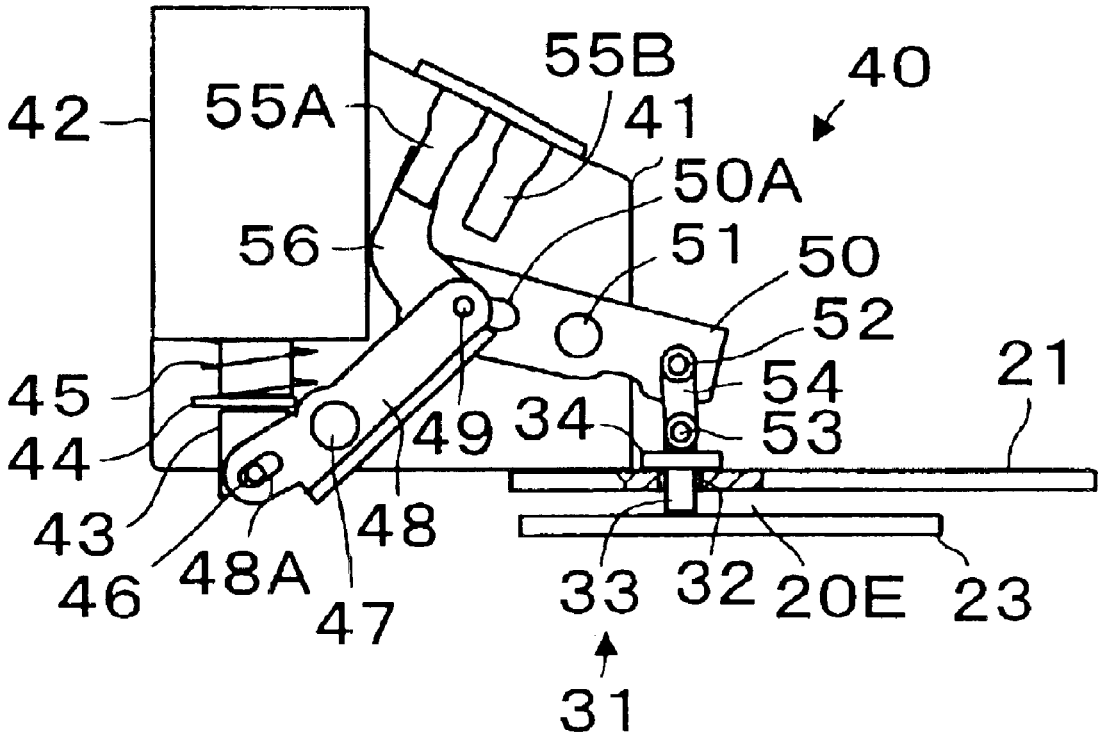
FIG. 3 is a plan view of the deflector unit of the driving device.

Next, the deflector unit 30 includes a diverter 31 and a position changing device 40 for the diverter 31. Diverter 31 can be a diverting pin 33 which is cylindrical and can slide in a guiding hole 32 which is located at base plate 21 as shown in FIG. 3. A large diameter section is located at the middle of the diverting pin 33 and forms a stopper 34 to limit movement of the diverting pin 33.

The diverting pin 33 is located on an extending passageway 20E which is located on the guiding passageway 20 and is further located at one side of a center line CL of the guiding passageway 20 and extending passageway 20E. Accordingly the diverting pin 33 is located at the left of the center line CL. The distance between the diverting pin 33 and the first end 22C of the spacer 22A is slightly smaller than the diameter of disc D. Therefore a disc D cannot pass between the diverting pin 33 and first end 22C. The position of the diverting pin 33 can be changed to the center line CL and spacers 22A, 22B. Therefore the diameter of guiding hole 32 can be formed larger, and the position of position changing device 40 can also be changed on the base plate 21.

The distance between diverting pin 33 and second end 22D of the spacer 22B is larger than the diameter of the disc D. The distance should be slightly larger than the diameter of the disc. The diverting pin 33 has a function of diverting the discs D traveling from the extending passageway 20E. The diverting pin 33 could be changed to a roller to reduce the moving resistance to the discs D. Also, the diverting pin 33 can be made up of a plate.

When the diverting pin 33 isn't a roller, it can be made out of stainless-steel, ceramic, resin with beaded-glass, etc. The diverting pin 33 is moved by an actuator unit. Therefore it can be made from a lightweight material (for example resin) for a quick response.

Next, the position changing device 40 of the diverting pin 33 is explained by referring to FIG. 3. A solenoid 42 is fixed at a bracket 41 which is in turn adjustably fixed to the reverse side of the base plate 21. An armature 43 is moved, to provide a protrusion of the pin 33, by a spring 45 which is located between the solenoid 42 and a spring retainer 44.

Pin 46 is fixed at the end of the armature 43 and is inserted into an elongated hole 48A which is located at the end of a first lever 48 which is borne on shaft 47 which is fixed at a bracket 41. Pin 49 is fixed at another end of the lever 48 and is inserted into an elongated hole 50A of a second lever 50. The second lever 50 is borne on a second shaft 51 which is fixed on the bracket 41. Pin 52 which is fixed at the end of the second lever 50 and pin 53 which is fixed at the end of the diverting pin 33 are linked by rod 54.

When solenoid 42 isn't excited, the diverting pin 33 protrudes into the extending passageway 20E and stopper 34 is stopped by the base plate 21 and is kept in a stopped position. Therefore the diverting pin 33 is selectively located at the extending passageway 20E by solenoid 42.

First photo-electrical sensor 55A and a second photo-electrical sensor 55B are fixed at bracket 41 and are located at a predetermined distance. When the diverting pin 33 is located in the extending passageway 20E, the first photo-electrical sensor 55A detects the operating piece 56 of the end of the lever 48. When the diverting pin 33 isn't located at the extending passageway 20E, the second photo-electrical sensor 55B detects the operating piece 56.

The position changing device 40 can be selectively located on or out of the extending passageway 20E. Accordingly the position changing device 40 isn't limited to the present embodiment. For example, when the solenoid 42 is excited, the diverting pin 33 can be located on the extending passageway 20E.

Next, the urging device 60 is explained by reference to FIGS. 2 and 4. The urging device 60 includes a contactor member 61 which can contact with a disc D and a biasing device 70 which can bias the contactor member 61 towards the guiding passageway 20. The contactor member 61 is a moving roller 63 which is rotatably supported on a movable shaft 62.

Figure 5:
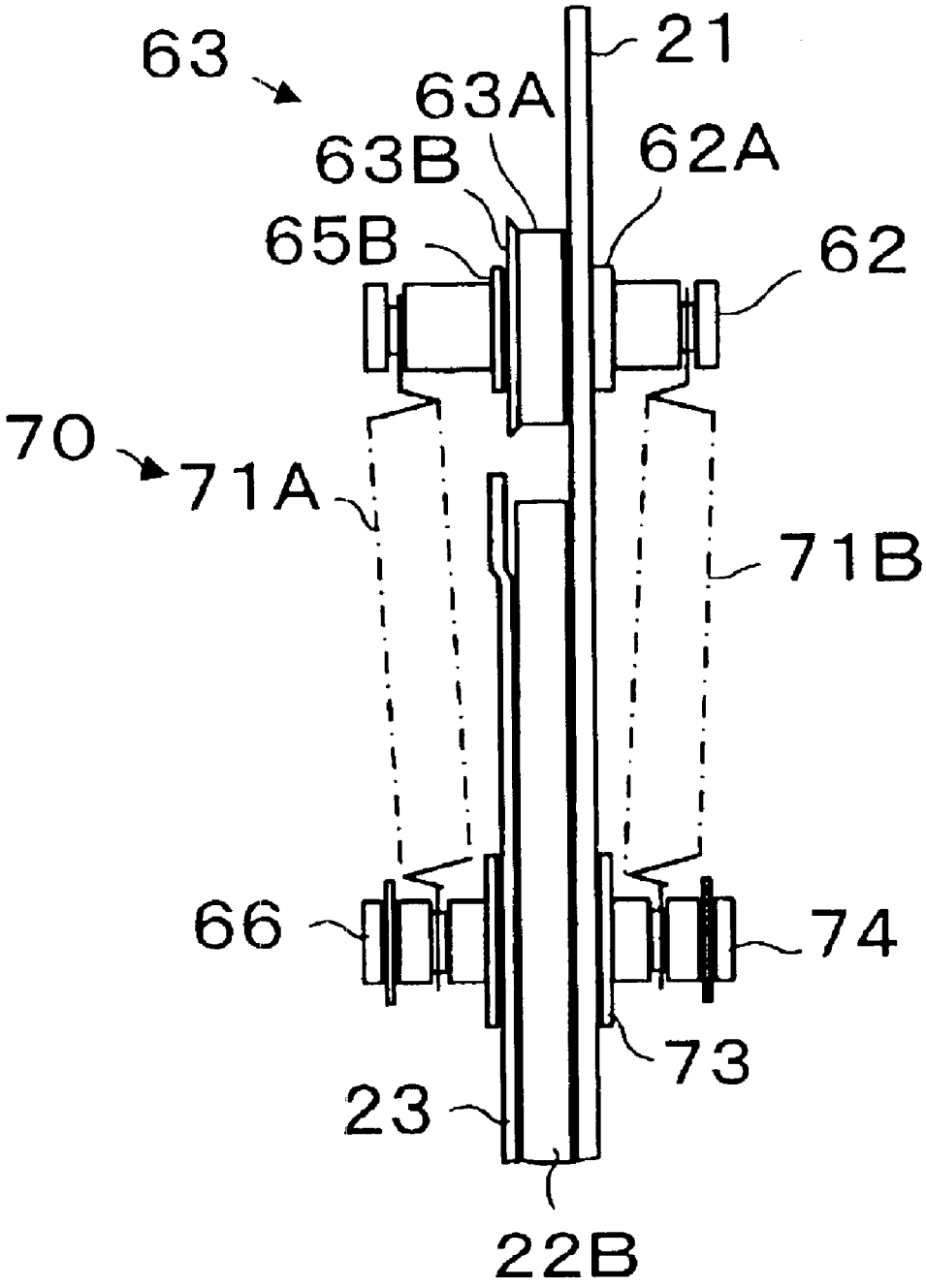
FIG. 5 is a right-hand side view of the deflecting unit and urging device.

As shown in FIG. 5, the moving roller 63 has a cylindrical section 63A and a tapered section 63B. The moving shaft 62 penetrates into a through hole 63C on the moving roller 63 and has a larger diameter section 62A in the middle portion. The width of the cylindrical section 63A is the same as the spacers 22A and 22B and is located over the spacers. The diameter of the tapered section 63B becomes gradually larger as it moves away from the cylindrical section 63A. Accordingly, the discs D which may be displaced from the cylindrical section 63A are guided to the cylindrical section 63A by the tapered section 63B. The moving shaft 62 penetrates elongated hole 64 from the reverse to the front of base plate 21 and can move along elongated hole 64 by a guiding snap ring 65A which is hooked to shaft 62 and the large diameter section 62A.

The moving shaft 62 penetrates the through hole 63C of the moving roller 63 and is prevented from dropping out from hole 63 by snap ring 65B which is hooked to shaft 62. Elongated hole 64 is in the extending passageway 20E and is located at one side of the center line CL and opposite the diverting pin 33 and is further parallel to the center line CL.

When the elongated hole 64 is positioned parallel to the center line, the moving roller 63 (the moving shaft) can be smoothly moved to the left or right. As a result, the disc D is dispensed smoothly.

When a disc D can be dispensed from either the first exit 80 or the second exit 81, the elongated hole 64 can be slanted or orthogonally to the center line CL. Usually the moving shaft 62 is stopped by the lower edge of the elongated hole 64, and the moving roller 63 is kept at a predetermined distance from the first end 22C and the second end 22D of the exit. This distance is smaller than the diameter of disc D.

But when the moving roller 63 is pushed by disc D, the moving roller 63 moves to at least the diameter of a coin D. Therefore discs D can pass through between the moving roller 63 and the edges of the exit. The stopper of the moving roller 62 can be changed to an exclusive use stopper which can be located adjustably on base plate 21.

First exit 80 is located between the first edge 22C and moving roller 63. Second exit 81 is located between second edge 22D and moving roller 63. The contactor member 61 could be changed to a fixed shaft or a plate. When the contactor member 61 is roller 63, the discs D are smoothly dispensed because the resistance of friction to the discs D is smaller.

Next biasing device 70 is explained by reference to FIGS. 2 and 5. Pin 66 is fixed on the center line of the elongated hole 64 at the holding plate 23. First spring 71A is hooked between pin 66 and the end of the moving shaft 62. Second pin 74 is fixed at second bracket 73 which is adjustable fixed towards the transversal direction at the reverse side of the base plate 21 by screws 72A, 72B.

The second pin 74 is located on the center line of the elongated hole 64 and on the axis of pin 66. Second spring 71B is hooked between the second pin 74 and the moving shaft 62. First spring 71A and the second spring 71B are located symmetrically to the center line of spacer 22B and the cylinder section 63A.

The first spring 71A and the second spring 71B have the same spring forces. Accordingly the moving shaft 62 can move parallel. When the moving shaft 62 moves parallel, the moving shaft 62 moves smoothly.

Therefore the coins are dispensed smoothly and equally. The biasing device 70 has a function that the contactor member 61 resiliently moves towards the guiding passageway 20. Accordingly the biasing device 70 can be changed to a rubber member or a gas cylinder type, etc.

Next detecting device 90 of the disc D is explained. Third photo-electrical sensor 92A (a reflection type detector) is fixed at the reverse side of the base plate 21 by contact with a spacer 91A and screws 93A and 93B. Openings 94A and 94B are located on the base plate 21 and on the spacer 91A for projection.

Fourth photo-electrical sensor 92B (a reflection type detector) is fixed at the base plate 21 by contact with spacer 91B and screws 93C and 93D. Openings 94C and 94D are located at base plate 21 and spacer 91B for projection. The opening 94A is located at the side of the pathway of disc D which passes through the first exit 80. The opening 94C is located at the side of the pathway of disc D which passes through the second exit 81.

The holding plate 23 isn't located in front of the openings 94A and 94C, but is positioned below them. Therefore the third sensor 92A and the fourth sensor 92B aren't given false readings by a reflection from the holding plate 23. Also, the detecting device 90 could be changed to a transmission sensor. In this case, a projector and a receiver would be located opposite in a face-to-face manner with the passageway of the discs D. Also the detecting device 90 can be changed to non-photo-electrical type and the detecting device 90 can detect the moving of the moving shaft 62 or the moving roller 63. In such a case there could only be one detecting device 90.

Figure 6:
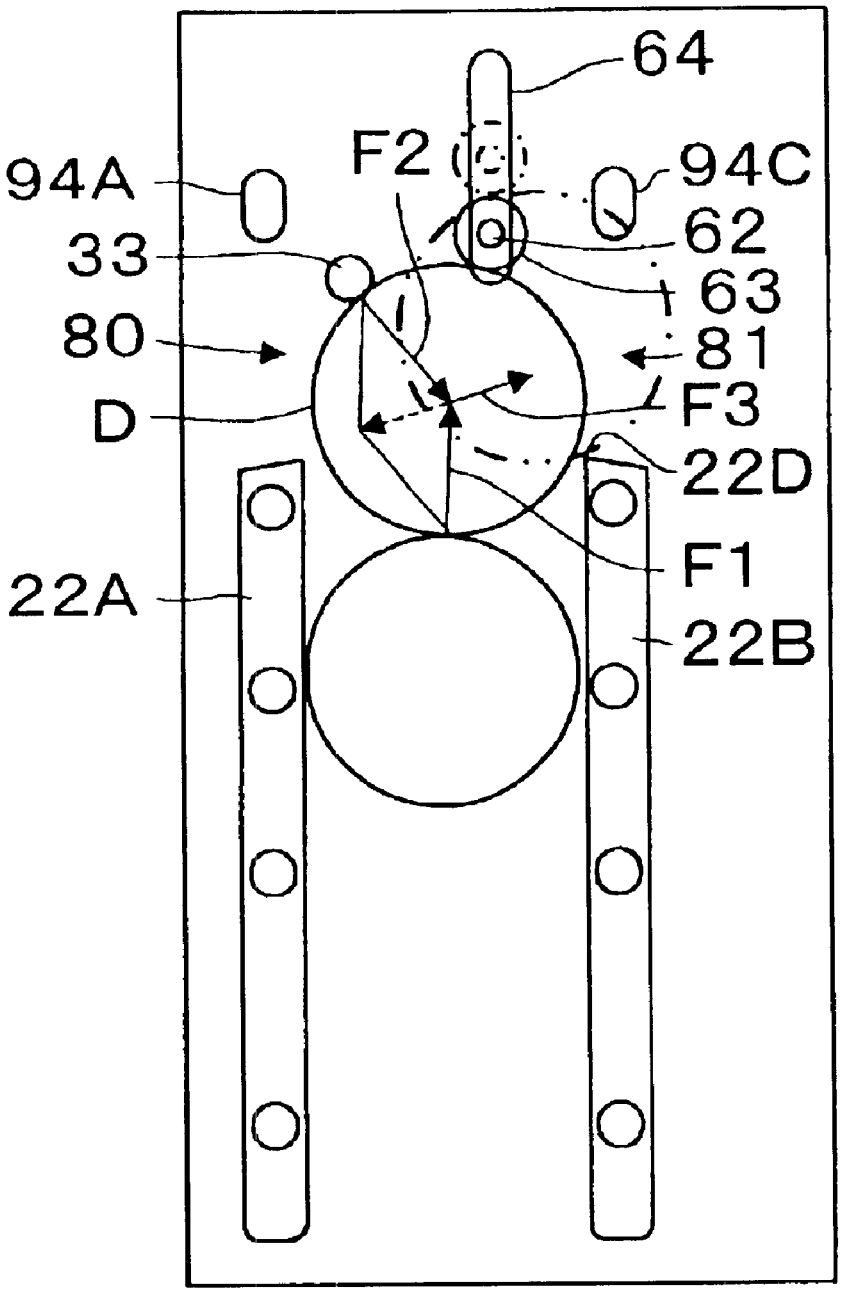
FIG. 6 is an explanatory partial view of the diverter device positioned in an extending passageway.

Next, the operation of the first embodiment is explained. First, the case where the diverting pin 33 is located in the extending passageway 20 is explained by referring to FIG. 6. The solenoid 42 is unexcited, and armature 43 is biased outward by the spring 44, so that the diverting pin 33 is located in the extending passageway 20E.

In this situation, the rotating selector disc 4 rotates, and lets off disc D to the escalator guiding passageway 7 in a one-by-one manner. The discs D are aligned in this situation and have contact with each other in the escalator guiding passageway 7. Discs D are pushed up by the introduction of new discs D, and reach the guiding passageway 20.

The top disc D releases from the guiding passageway 20 into the extending passageway 20E and has contact with the diverting pin 33. Additionally, the left side of the disc D has initial contact with the diverting pin 33 because the diverting pin 33 is located on the left side away from the center line CL. Disc D is pushed further up. In this process, the disc D is pushed by force F1 from the follow-on discs and receives an opposed force F2 from the diverting pin 33.

The first force F1 has a vector which is located on approximately the center line CL. The opposed force F2 has a vector which is crossed at the center line CL to a blunt angle because the diverting pin 33 is located away from the center line. Accordingly the resultant force F3 from the first force F1 and the opposed force F2 has a vector which is towards the second exit 81. Therefore disc D is guided to the second exit 81.

The moving roller 63 is moved along the elongated hole 64 by contact with disc D because the distance between the second end 22D and the moving roller 63 is smaller than the diameter of the disc D. When the diameter section of the disc D passes through between the second edge 22D and the moving roller 63, the moving roller 63 is pulled back towards the guiding passageway 20 by the spring, and the disc D is dispensed from the second exit 81.

Afterwards, the fourth detecting device 92B detects the disc D, and outputs a detecting signal. The detecting signal is used to count the discs D and/or to detect a possible dispensing mistake. The moving roller 63 can contact the disc D before contact with the diverting pin 33.

Figure 7:
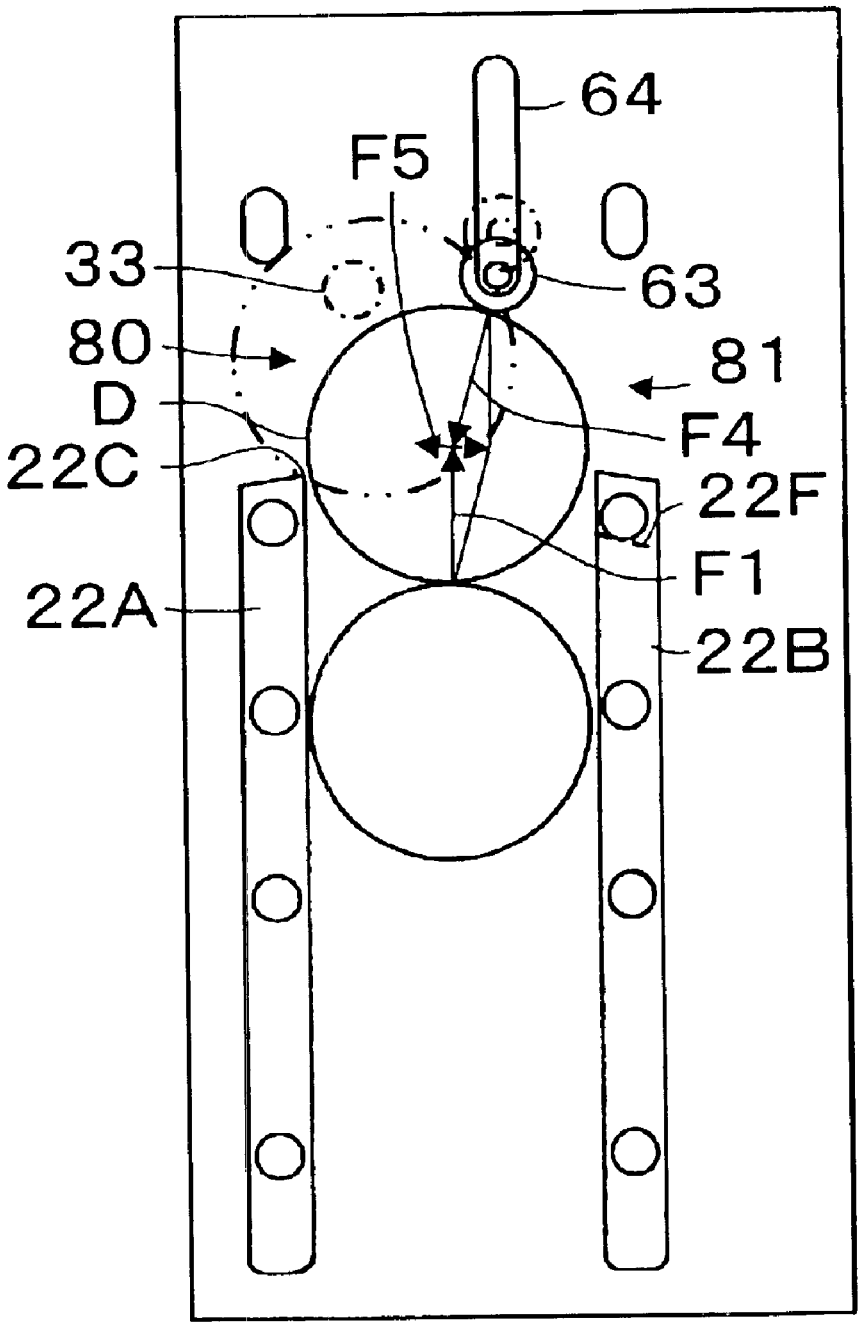
FIG. 7 is an explanatory partial view with the diverter device retracted on the extending passageway.

Next, the case that the diverting pin 33 isn't located in the extending passageway 20E is explained by referring to FIG. 7. First, the right side of the disc D has contact with the moving roller 63. Accordingly, disc D receives a first force F1 which is located on the center line CL and an opposed force F4 from the moving roller 63 by the after disc D. The resultant force F5 between the first force F1 and the second opposed force F4 has a vector towards the first exit 80.

Therefore disc D moves upwards and has contact with the first end 22C, and pushes up the moving roller 63. When the diameter section of the disc D passes through between the first end 22C and the moving roller 63, the disc D is energetically dispensed from the first exit 80 by the biasing device 70. Immediately after the coin D is dispensed, the disc D is detected by the third detecting device 92A.

In this embodiment, the distance between the first end 22C and the moving roller 63 is larger than the distance between the second end 22D and the moving roller 63. Accordingly the moving amount of the moving roller 63 is smaller than the case where the disc passes through the second exit 81.

As a result, the relative disc's speed between the case of dispensing from the first exit 80 and the case of dispensing from the second exit 81 will differ. Accordingly a possible mistake for the detecting device 90 is an issue. Therefore, the end section of the spacer 22B is cut at mark 22F as shown in FIG. 7. As a result, the moving amount between a case to dispense from the first exit 80 and the case to dispense from the second exit 81 becomes the same.

Figure 8:
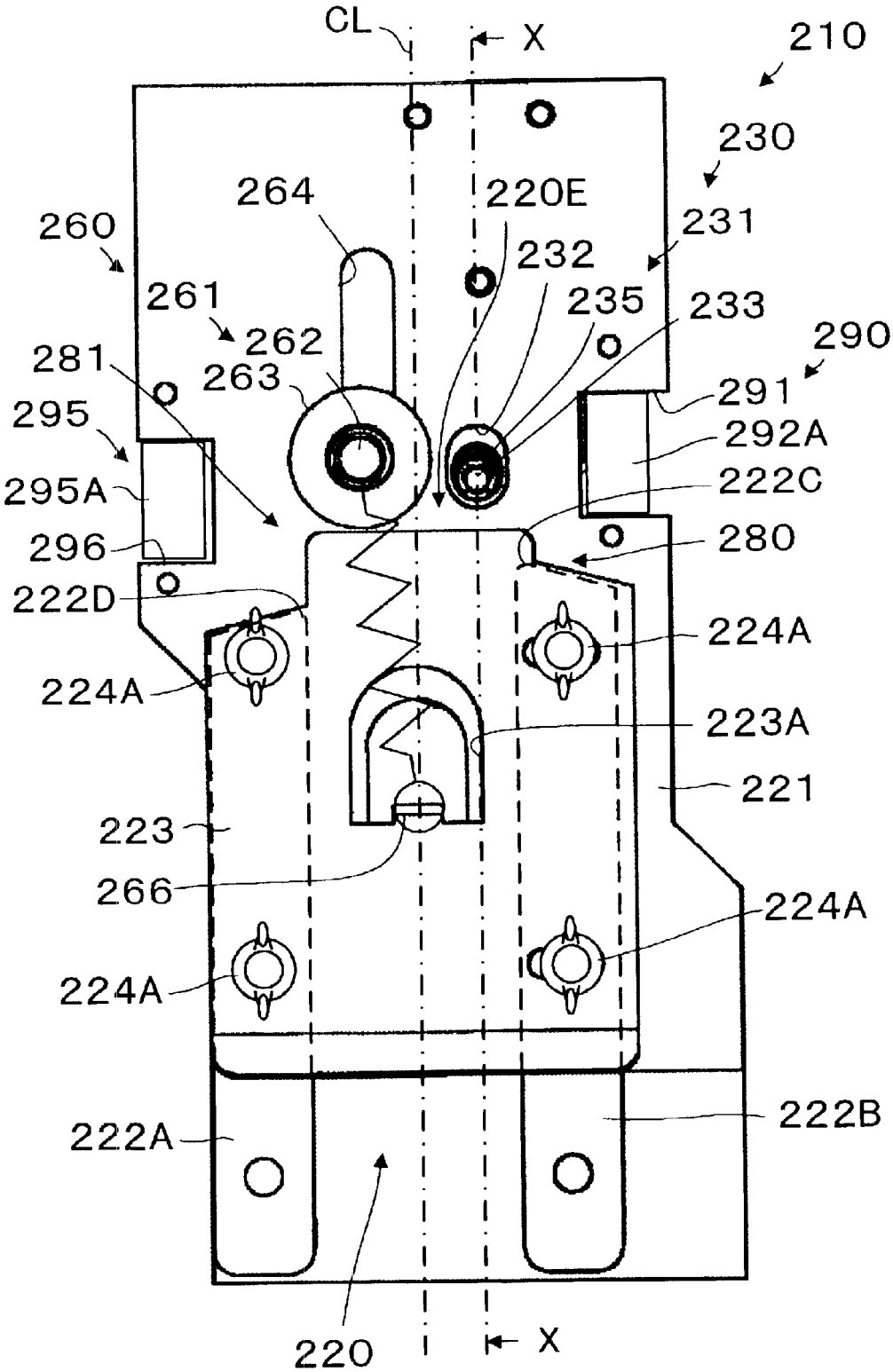
FIG. 8 is a front elevational view of the defector device of a second embodiment.
Figure 14:
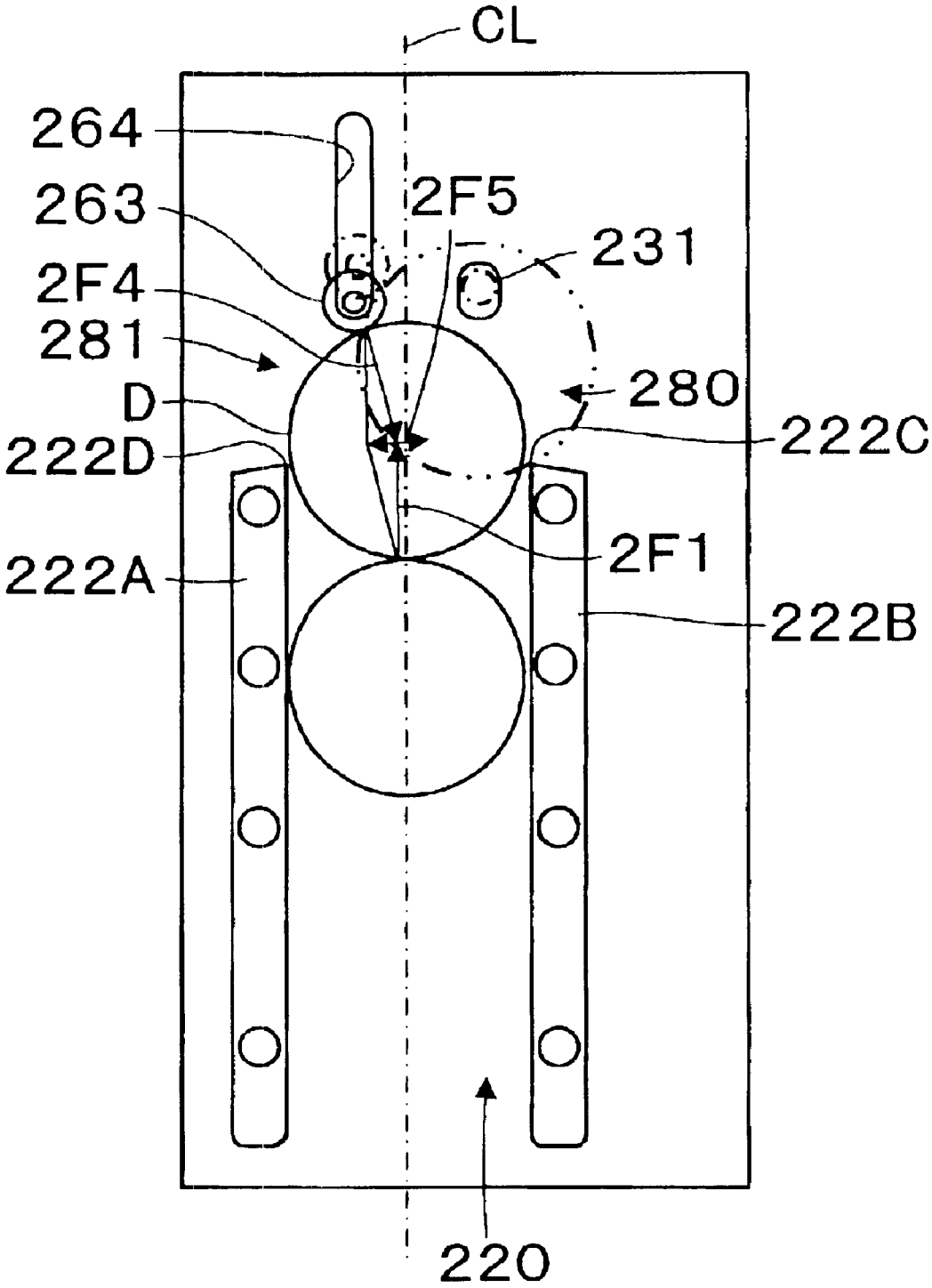
FIG. 14 is an explanatory partial view with the diverter device retracted from the extending passageway.

Next, a second embodiment is explained (as shown in FIG. 8 through to FIG. 14). Diverting device 210 is attached at the top of escalator 5. The diverting device 210 includes a guiding passageway 220, a deflector unit 230, an urging device 260, a first exit 280, a second exit 281 and a disc detecting device 290.

Figure 9:
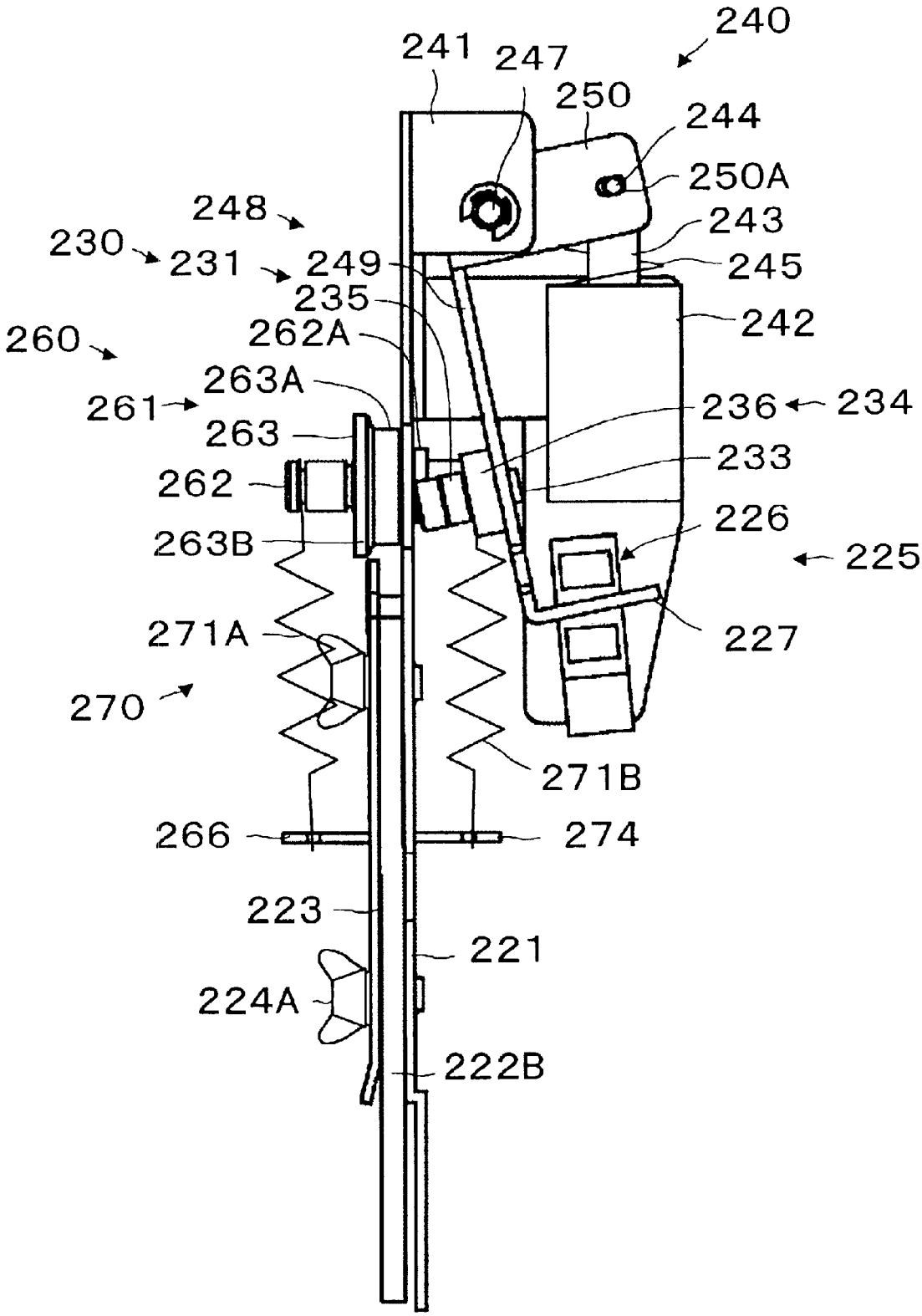
FIG. 9 is a right side of the second embodiment.

First, guiding passageway 220 is explained. As shown in FIGS. 8 and 9, base plate 221 is rectangular in shape and the lower section is crank like in shape and extends perpendicular. A pair of spacers 222A, 222B are located at the front side (the left side in FIG. 9) of base plate 221, and they are parallel (as shown in FIG. 9). The spacers 222A and 222B are the guiding plates.

The spacers 222A, 222B are rectangular like in shape, and their upper sections slant downwards to the outside and their distance is slightly larger than the diameter of disc D. When a different diameter of disc D is used, the base plate 221 is changed and the distance between the spacers 222A, 222B is changed to adapt to the new diameter.

Screws 224A penetrate into rectangle holding plate 223 and spacer 222A, and screw into the base plate 221 to connect them. Screws 224B also penetrate into rectangle holding plate 223 and spacer 222B, and screw into the base plate 221.

The guiding passageway 220 is enclosed by base plate 221, spacers 222A, 222B and holding plate 223. The guiding passageway 220 is rectangular from a cross-section view and extends perpendicular. The width and thickness of the guiding passageway 220 is slightly larger than the diameter of disc D. Hole 223A for guiding passageway 220 extends perpendicular and is located at the middle of holding plate 223.

A plate veers into a right angle to the base plate 221 of scope hole 223A and forms a latch 266. When the diverting device 210 is fixed at the top of the escalator 5, the spacers 222A, 222B are located on an extending line of the spacers (not shown). Therefore the guiding passageway 220 is located at the extending line of escalator guiding passageway 7. As a result discs D are pushed upwards from escalator guiding passageway 7 to escalator guiding passageway 220.

The diverting device 230 includes a diverter 231 and a position changing device 240 of diverter 231. The diverter 231 is cylindrical and can move into or can go out of the extending passageway 220E from the base plate as shown in FIG. 9. The diverter 231 includes a roller 235 which rotates on shaft 233 by a bushing (not shown). The extending section 236 is located at the base of the shaft 233 and forms a stopper 234.

Roller 235 is located on the extending passageway 220E which is located on the guiding passageway 220 and is located on the one side of the center line CL of guiding passageways 220 and 220E. Accordingly the roller 235 is located at the right side of the center line CL. The distance between the roller 235 and the first end 222C of the spacer 222B is slightly smaller than the diameter of the disc D. Therefore a disc D cannot pass between the roller 235 and the first end 222C.

The position of the diverter 231 can be changed to the center line CL between spacers 222A, 222B. Therefore hole 232 is formed larger, and the position of the position changing device 240 can be changed on the base plate 21 along the lateral direction.

The distance between the roller 235 and the second end 222D of the spacer 222A is larger than the diameter of the disc D. The distance should be slightly larger than the diameter of a coin. The diverter 231 has a function of diverting the discs D from the extending passageway 220E. The diverter 231 could be changed to a shaft. Also, the diverter 231 can be made up of a plate number.

When the diverter 231 isn't a roller, it can be made of stainless-steel, ceramic, resin with beaded-glass, etc. The diverter 231 is further moved by an actuator. Therefore it can be made from a lightweight material (for example resin) for quick response.

Figure 10:
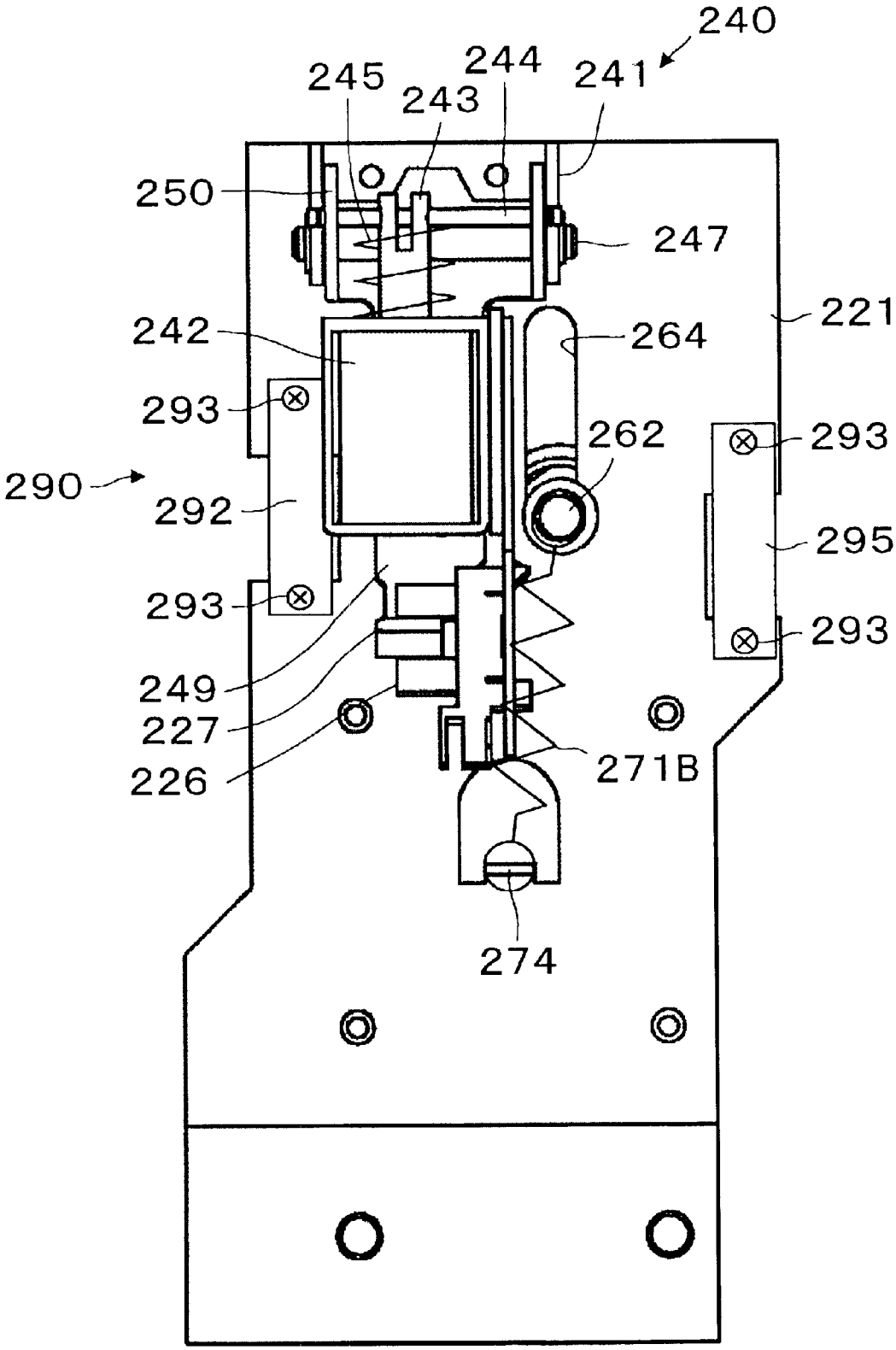
FIG. 10 is a rear elevational view of the second embodiment.

Next, position changing device 240 of the diverter 231 is explained by referring to FIGS. 9 and 10. An actuator is fixed at bracket 241 which is fixedly adjustable to the reverse side of base plate 221. The actuator is a solenoid 242; however, it could be changed to a fluid actuator or an electrical motor, etc. When a solenoid 242 is used, it is relatively inexpensive. Armature 243 is moved towards a protruding direction (in FIG. 9 upwards) by spring 245 which is located between the solenoid 242 and a pin 244 which is fixed at armature 243. The armature 243 is the actuator when excited by an electric field.

Pin 244 is fixed at the end of armature 243 and is inserted into an elongated hole 250A which is located at the end of a second lever 250 which has an inverted L shape and is borne by shaft 247 which is fixed at bracket 241. Lever 248 includes a first lever 249 which is approximately parallel to the guiding passageway 220 and second lever 250 which extends along the lateral direction from the upper section of the first lever 249. The second lever is approximately at a right angle to the first lever 249. Shaft 233 is fixed at the middle of the first lever 249 at a right angle. Accordingly diverter 231 is attached at the first lever 249 and extends at a right angle.

When solenoid 242 isn't excited, diverter 231 is positioned out of the extending passageway 220E. Accordingly the pin 244 is pushed up by the spring 245, and the lever 248 pivots in the counterclockwise direction. Therefore the first lever 249 is positioned away from the extending passageway 220E, and the diverter 231 leaves the hole 232.

Figure 11:
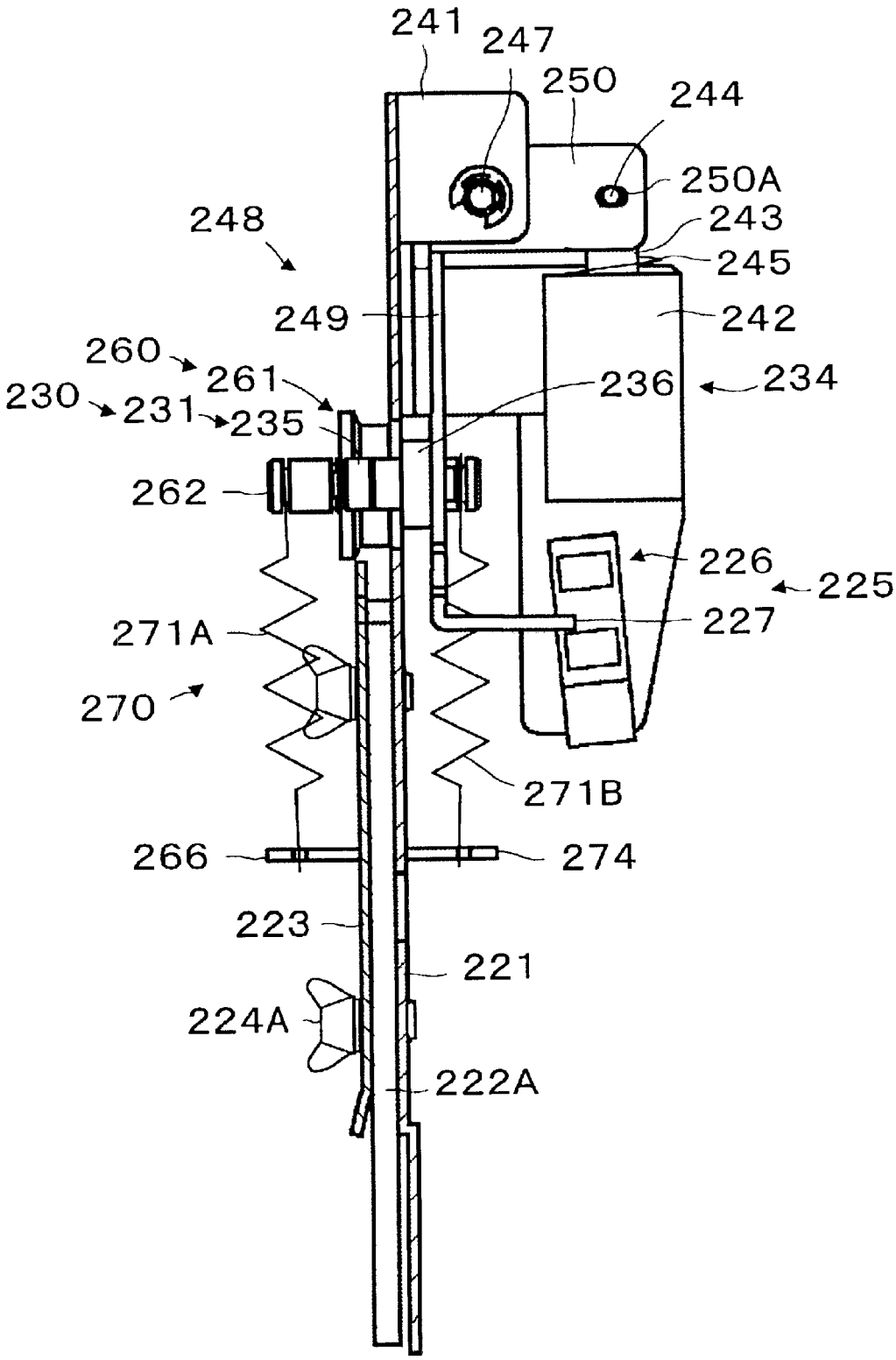
FIG. 11 is a cross-sectional view taken along the lines X—X of FIG. 8 with the diverter located in the guiding passageway.

When the solenoid 242 is excited, the armature 243 is drawn downwards. The lever 248 pivots in the clockwise direction, and the first lever 249 becomes parallel to the base plate 221 (the guiding passageway 220) as shown in FIG. 11. The end of the extending section 236 is stopped by the rear of the base plate 221. Accordingly the diverter 231 is selectively located at the extending passageway 220E by the solenoid 242 and the spring 245.

The position sensor 225 detects the position of the diverter 231 which is located in or outside of the extending passageway 220E. The position sensor 225 includes a photo-electrical sensor 226 which is fixed at the lower section of the bracket 241 and an operating piece 227 which bends from the lower section opposite the guiding plate 221 in a right angle.

When diverter 231 is located in the extending passageway 220E, the photo-electrical sensor 226 doesn't detect the operating piece 227 at the end of the first lever 249. Accordingly the position of the diverter 231 is detected as located in the extending passageway 231. When diverter 231 isn't located at the extending passageway 220E, the photo-electrical sensor 226 detects the operating piece 227. Therefore the position of the diverter 231 is detected as located out of the extending passageway 231.

The position changing device 240 can be selectively located on or out of the extending passageway 220E. Accordingly the position changing device 240 isn't limited to the present embodiment. For example, when the solenoid 242 isn't excited, diverter 231 could be located in the extending passageway 220E.

Next, the urging device 260 is explained. The urging device 260 includes contactor 261 which has contact with disc D and biasing device 270 which biases the contactor 261 towards the guiding passageway 220. The contactor 261 is a moving roller 263 which is rotatable and supported on a moving shaft 262.

As shown in FIG. 9, the moving roller 263 has a cylindrical section 263A and a tapered section 263B. The moving shaft 262 penetrates into the through hole of moving roller 263 and has a large diameter section 262A at the middle portion. The width of cylindrical section 263A is the same as spacers 222A and 222B and is located over the spacers.

The tapered section 263B becomes gradually larger from the cylindrical section 263A. Accordingly the discs D which are positioned away from the cylindrical section 263A are guided to the cylindrical section 263A by the tapered section 263B. The moving shaft 262 penetrates elongated hole 264 from the reverse to the front of the base plate 221 and can move along the elongated hole 264 by guiding a snap ring (not shown) which is hooked to the moving shaft 262 and the large diameter section 262A.

The moving shaft 262 penetrates the through hole of the moving roller 263 and is prevented from dropping out of the hole by a snap ring (not shown) which is hooked to the shaft 262. The elongated hole 264 corresponds in position to the extending passageway 220E and is located at one side of the center line CL and is opposite the diverter 231 and is further parallel to the center line CL.

When the elongated hole 264 is positioned parallel to the center line CL, the moving roller 263 (the moving shaft 262) can be smoothly moved to the left or to the right. As a result, disc D can be dispensed smoothly. When disc D can be dispensed from the first exit 280 and the second exit 281, the elongated hole 264 can be located either on a slant or orthogonal to the center line CL. Usually the moving shaft 262 is stopped by the lower edge of the elongated hole 264, and the moving roller 263 is kept at a predetermined distance from the first end 222C and the second end 222D. This distance is smaller than the diameter of disc D.

But when the moving roller 263 is pushed by disc D, the moving roller 263 moves at least the diameter of the coin D. Therefore the discs D pass between the moving roller 263 and the respective ends. The stopper of moving shaft 262 can be changed to be an exclusive use stopper which can be adjustable, located on base plate 221.

First exit 280 is between the first end 222C and the moving roller 263. Second exit 281 is between the second end 222D and the moving roller 263. The contactor member 261 could be changed to a fixed shaft or a plate. When the contactor member 261 is the roller 263, the discs D can be smoothly dispensed because the resistance of friction to the discs D is smaller.

Next biasing device 270 is explained. First spring 271A is hooked between the first latch 266 and the end of the moving shaft 262. Second latch 274 is extended towards the transversal direction at the reverse side of the base plate 221 and is located opposite first latch 266.

The second latch 274 is located on the axis line of the first latch 266. Second spring 271B is hooked between the second latch 274 and the moving shaft 262. The first spring 271A and the second spring 271B are located symmetrical to the guiding passageway 220 and the extending passageway 220E.

The first spring 271A and the second spring 271B have the same spring forces. Accordingly the moving shaft 262 can move parallel to the elongated hole 264. When the moving shaft 262 moves parallel, the moving shaft 262 can move smoothly.

Therefore the coins are dispensed smoothly and equally. The biasing device 270 has a function that the contactor 261 is resiliently biased towards the guiding passageway 220. Accordingly the biasing device 270 can be changed to a rubber member or a gas cylinder type, etc.

Next detecting device 290 of the disc D is explained. Fifth photo-electrical sensor 292 (a transmission type) is fixed at the reverse side of the base plate 221 by screws 293. Sensor head 292A is located at the side of extending passageway 220E and passes through notch 291 on base plate 221.

Figure 12:
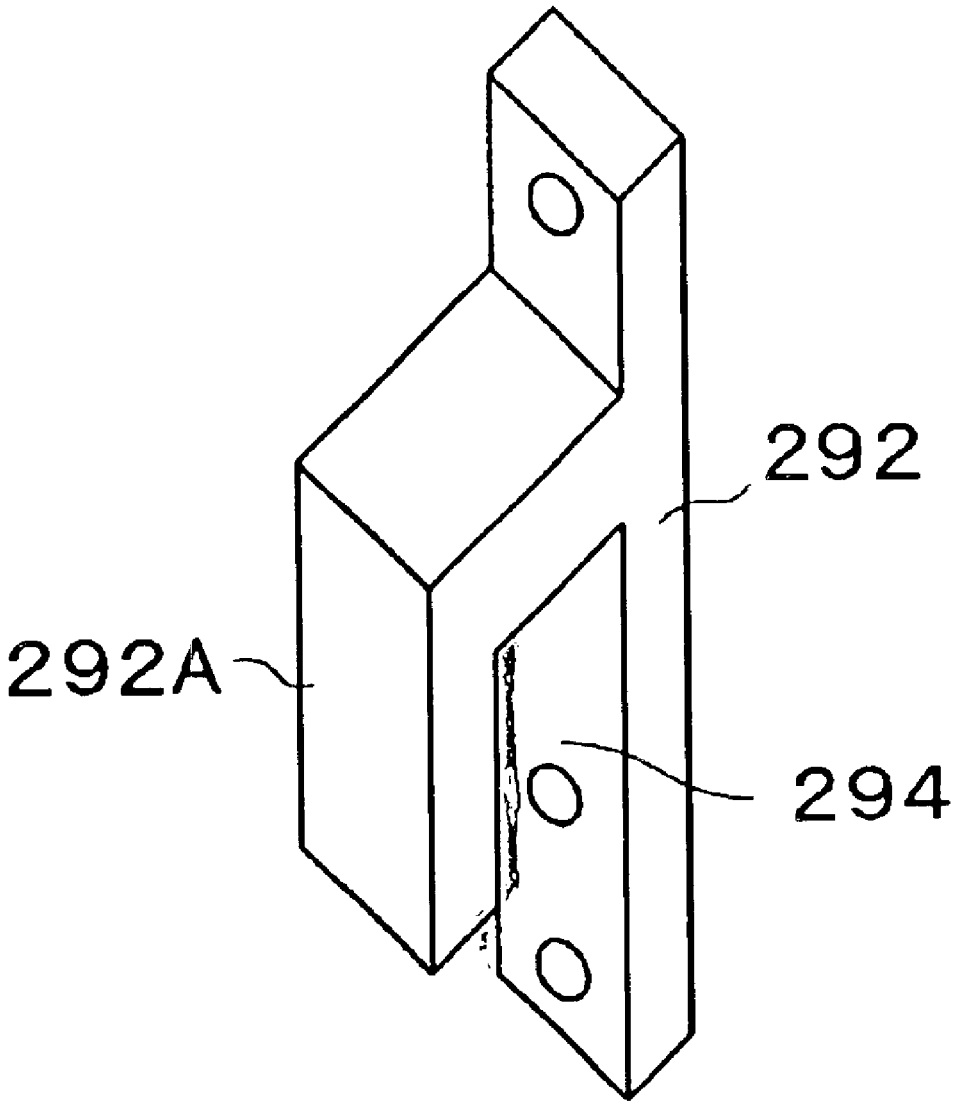
FIG. 12 is a perspective view of a detecting device.

The sensor head 292A has a gate like shape as shown in FIG. 12, and the intermediate passageway 294 continues to the first exit 280. Accordingly when the disc D passes through the passageway 294, the axis of the light is interrupted by the disc D and passing of the disc D is detected.

Sixth photo-electrical sensor 295 (a transmission type detector) is fixed on the base plate 221 by screws 293. Sensor head 295A is located at the side of extending passageway 220E and passes through notch 296 of base plate 221 and is located to the left side of extending passageway 220E. The sensor head 295A is also gate shaped, the same as the fifth photo-electrical sensor 292, and the passageway 294 continues to the second exit 281. Accordingly when disc D passes through the passageway 294, the light axis is interrupted by the disc D and passing of the disc D is detected.

The detecting device 290 can be changed to a reflection type or to an non-photo-electrical sensor. Also, the detecting device 290 can detect the movement of the moving shaft 262 or the moving roller 263. In this case the detecting device 290 need only be one unit.

Figure 13:
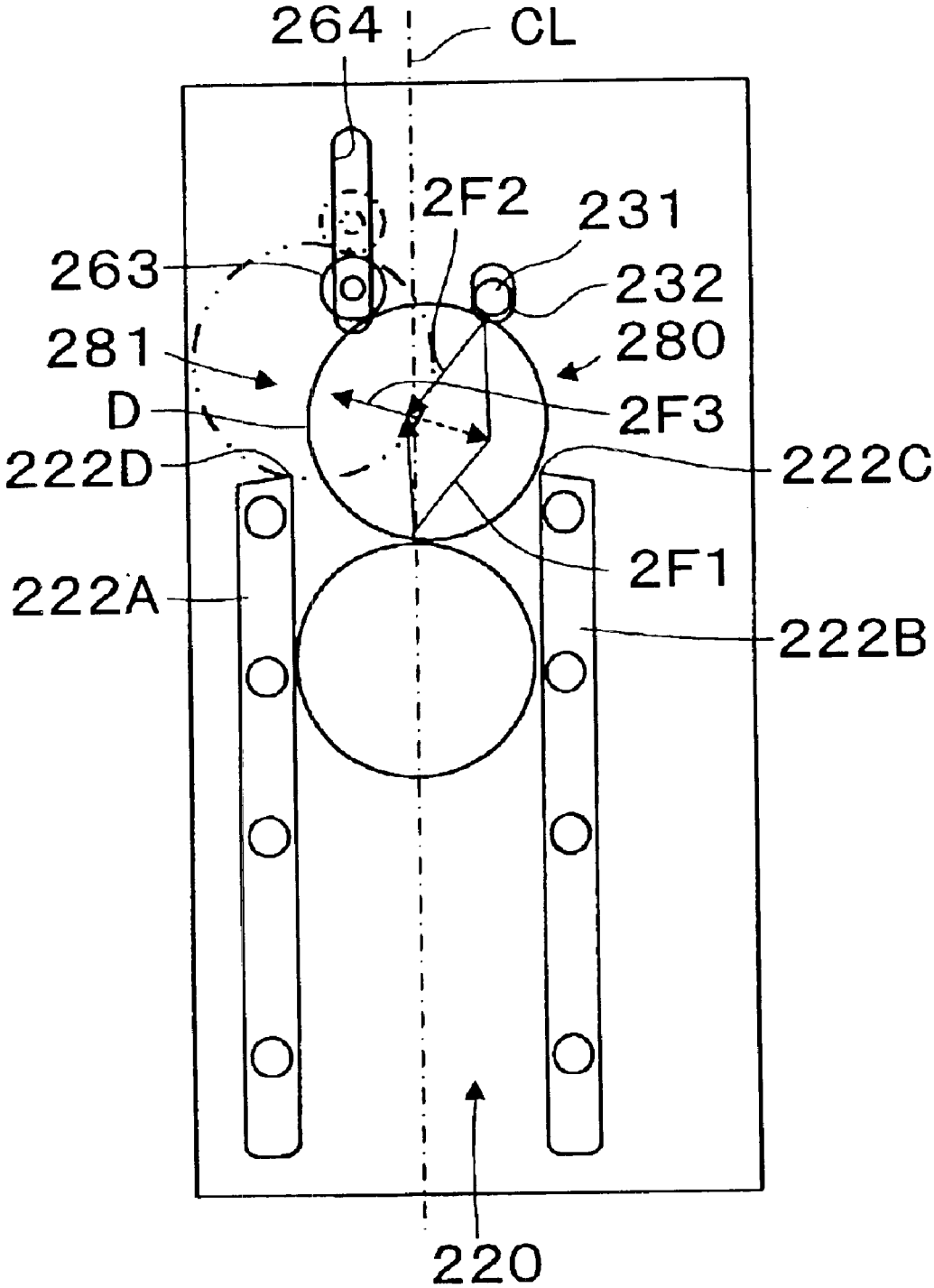
FIG. 13 is an explanatory partial view of the diverter device positioned in an extending passageway.

Next, the operation of the second embodiment is explained. First, the case where the diverter 231 is located in the extending passageway 220, is explained by referring to FIG. 13. The solenoid 242 is unexcited, and armature 243 is pulled down, by the spring force so that diverter 231 is located in extending passageway 220E (as shown in FIG. 11).

In this situation, the rotating disc 4 rotates, and releases the discs D to the guiding passageway 7 one by one.

The top disc D goes from the guiding passageway 220 into the extending passageway 220E and has contact with diverter 231. Additionally, the right side of the disc D has contact with the diverter 231 because the diverter 231 is located at the right side of the center line CL.

Disc D is pushed up further. In this process, disc D is pushed by a force 2F1 from a follow-on disc and receives an opposed force 2F2 from the diverter 231.

The first force 2F1 has a vector which is located on approximately the center line CL. The opposed force 2F2 has a vector which is crossed to the center line CL at a blunt angle because the diverter 231 is located away from the center line CL. Accordingly the resultant force 2F3 between the first force 2F1 and the opposed force 2F2 produce a force vector towards the second exit 281. Therefore the disc D is guided to the second exit 281.

The moving roller 263 is moved along the elongated hole 264 by disc D because the distance between the second end 222D and the moving roller 263 is smaller than the diameter of the disc D.

When the diameter section of the disc D passes between the second end 222D and the moving roller 263, the moving roller 263 is pulled towards the guiding passageway 220 by the biasing device 270, and the disc D is dispensed from the second exit 281.

Afterwards, the sixth detecting device 295 detects disc D, and outputs a detecting signal. The detecting signal is used for counting the number of discs D and/or to detect a dispensing mistake. The moving roller 263 can contact the disc D before it has contact with the diverter 231.

Next, the case where the diverter 231 isn't located in the extending passageway 220E, is explained by referring to FIG. 14. First, the left side of disc D has contact with the moving roller 263. Accordingly, disc D receives a first force 2F1 which is located on the center line CL and an opposed force 2F4 from the moving roller 263 by the after disc D. The resultant force 2F5 between the first force 2F1 and the second opposed force 2F4 has a vector towards the first exit 280.

Therefore the disc D moves upwards and has contact with the first end 222C, and pushes up the moving roller 263. When the diameter section of disc D passes between the first edge 222C and the moving roller 263, the disc D is energetically dispensed from the first exit 280 by the biasing device 270. Immediately after the coin D is dispensed, disc D is detected by the first detecting device 292.

What is claimed is:

1. A diverting device for discs comprising:

a guiding passageway (20,220) which guides and aligns the discs D;

a contactor member (61,261) which is located at an extending passageway from the guiding passageway (20,220) and is positioned away from a center line (CL) of the guiding passageway, the contactor member is biased towards the guiding passageway; and a diverter (31,231) which is located adjacent the extending passageway and can be selectively located in the extending passageway opposite from the contactor member.

2. The diverting device as claimed in claim 1, whereby the guiding passageway (20,220) includes a base plate (21,221);

a pair of guiding plates (22A, 22B, 222A, 222B) which are fixed to the base plate and are positioned away by a predetermined parallel distance from each other; and a supporting plate (23,223) which is located on a side of the guiding plate opposite the base plate.

3. The diverting device as claimed in claim 1, whereby the contactor member (61,261) includes a roller (63,263) which is rotatable on a supporting shaft (62,262) and an urging device (70,270) which urges both ends of the supporting shaft towards the guiding passageway.

4. The diverting device as claimed in claim 2, whereby a position of an end of one guiding plate (22B, 222A) near the contactor member (61,261) differs from another guiding plate (22A, 222B).

5. The diverting device as claimed in claim 1, whereby the diverter (231) is attached to a lever unit (248) which is located away from the center line (CL) of the guiding passageway (220) and crosses perpendicular to the center line.

6. The diverting device as claimed in claim 5, whereby the lever unit (248) includes a first lever (249) which is located parallel to the guiding passageway (220) and a second lever (250) which extends perpendicular to the guiding passageway (220) from an upper section of the first lever (249), and has an inverted L shape, the second lever (250) is pivotal on a shaft (247) and the shaft (247) is positioned away from the first lever (249) to the guiding passageway (220); and a mover (243) having an actuator (242) linked to the second lever and the linked position is further away than the shaft.

7. In a coin dispensing mechanism, the improvement of a disc diverting device operatively positioned in a disc guiding passageway comprising:

a movable contactor member positioned adjacent an exit aperture of the guiding passageway for contacting a disc and directing the disc in a first direction;

a diverter member that can be selectively inserted adjacent the exit aperture for contacting a disc and directing the disc in a second direction; and a position changing unit for selectively inserting and extracting the diverter member adjacent the exit aperture.

8. The coin dispensing mechanism of claim 7 wherein the movable contactor member is spring biased to a predetermined location adjacent the exit aperture.

9. The coin dispensing mechanism of claim 8 wherein the diverter member is a pin that can extend through a diverter hole in the guiding passageway adjacent the exit aperture.

10. The coin dispensing mechanism of claim 9 wherein the diverter hole is offset from a center line of the guiding passageway and the diverter member forces a disc to contact and move the contactor member as it travels in the second direction.

11. The coin dispensing mechanism of claim 10 wherein the position changing unit is a solenoid actuator to insert the diverter member in a perpendicular direction to a plane containing the center line.

12. A method of diverting coins released by a coin dispensing mechanism comprising the steps of:

forcing a series of coins along a coin guiding passageway with a contactor member moveably mounted adjacent an exit aperture;

permitting the contactor member to contact and direct a coin in a first direction at the end of the coin guiding passageway; and inserting a diverter member adjacent the exit aperture and off a center line of the coin guiding passageway to contact a coin and force the coin to contact and move the contactor member as it travels in a second direction.

13. The method of claim 12 wherein the diverter member is inserted perpendicular to a plane containing the center line.

* * * * *